US007460949B2

(12) United States Patent
Wilbrod

(10) Patent No.: US 7,460,949 B2
(45) Date of Patent: Dec. 2, 2008

(54) METHOD AND SYSTEM FOR DETECTING THE PRESENCE OF A DISRUPTIVE OBJECT AND ACTIVATION MODULE FOR THIS SYSTEM

(75) Inventor: Jean-Hubert Wilbrod, Saint Maur des Fosses (FR)

(73) Assignee: Neavia, Creteil (FR)

( * ) Notice: Subject to any disclaimer, the term of this patent is extended or adjusted under 35 U.S.C. 154(b) by 419 days.

(21) Appl. No.: 11/393,925

(22) Filed: Mar. 31, 2006

(65) Prior Publication Data

US 2006/0235612 A1 Oct. 19, 2006

(30) Foreign Application Priority Data

Mar. 31, 2005 (FR) ..... 05 03145

(51) Int. Cl.
*G06G 7/76* (2006.01)
*G08G 1/04* (2006.01)
*G08G 1/056* (2006.01)

(52) U.S. Cl. ..... 701/118; 340/928; 340/932; 340/934; 340/935; 340/937; 340/942; 340/943; 367/191; 382/104

(58) Field of Classification Search ..... 701/118
See application file for complete search history.

(56) References Cited

U.S. PATENT DOCUMENTS 7,132,933 B2 * 11/2006 Nakai et al. ..... 340/435
2002/0059017 A1 * 5/2002 Yamane et al. ..... 701/1
2003/0099400 A1 * 5/2003 Ishikawa ..... 382/190
2004/0096082 A1 * 5/2004 Nakai et al. ..... 382/104
2005/0169530 A1 * 8/2005 Nakai et al. ..... 382/190
2006/0025896 A1 * 2/2006 Traechtler et al. ..... 701/1

FOREIGN PATENT DOCUMENTS

| | | | |
|---|---|---|---|
| DE | 19727895 | | 2/1999 |
| EP | 0396432 | * | 11/1990 |
| EP | 0856826 | * | 8/1998 |
| EP | 1414000 | | 4/2004 |
| EP | 1414000 | * | 4/2008 |

* cited by examiner

*Primary Examiner*—Thomas G. Black
*Assistant Examiner*—Shelley Chen
(74) *Attorney, Agent, or Firm*—Womble Carlyle Sandridge & Rice, PLLC

(57) ABSTRACT

This method of detecting the presence of a disruptive object on a stretch of road comprises:

a step (66) of enumerating the vehicles simultaneously present on the stretch of road on the basis of data gleaned by a first and a second vehicle detector placed respectively at an entrance and at an exit of this stretch, and a step (74) of instructing the activation of an image processing step, triggered automatically as a function of the enumeration.

11 Claims, 3 Drawing Sheets

METHOD AND SYSTEM FOR DETECTING THE PRESENCE OF A DISRUPTIVE OBJECT AND ACTIVATION MODULE FOR THIS SYSTEM

CROSS REFERENCE TO A RELATED APPLICATION

This application claims priority to French application number 05031445 filed Mar. 31, 2005.

The present invention relates to a method and to a system for detecting the presence of a disruptive object, and to an activation module for this system.

There exist methods of detecting presence of a disruptive object on a stretch of road comprising a step (a) of processing images to detect the presence of the disruptive object on the basis of images of the said stretch.

The image processing step is carried out continuously so as to be able to rapidly detect the presence of this possible disruptive object.

The disruptive object may be a stationary vehicle or a vehicle involved in an accident or else any other object present on the carriageway of the stretch of road.

The processing of images requires significant calculational power and consumes a great deal of energy. This significant energy consumption is especially problematic when the image processing step is carried out by an autonomous road traffic beacon placed at the verge of the stretch of road.

The invention aims to remedy this drawback by proposing a method making it possible to detect the presence of a disruptive object but while consuming less energy or requiring diminished calculational power.

The subject of the invention is therefore a method of detecting the presence of a disruptive object comprising:

b) a step of enumerating the vehicles simultaneously present on the stretch of road on the basis of data gleaned by a first and a second vehicle detector placed respectively at an entrance and at an exit of this stretch, and c) a step of instructing the activation of the image processing step, triggered automatically as a function of the enumeration of step b).

The presence of a disruptive object on a stretch of road is manifested through a variation in the road traffic and, conventionally through a rise in the number of motor vehicles simultaneously present on this stretch. In the above method, the image processing is no longer activated permanently, but only when it seems necessary, the instant at which the image processing seems necessary being determined on the basis of the enumeration of the vehicles simultaneously present on the stretch. Thus, by virtue of the above method, the energy consumption due to the image processing is limited.

The embodiments of this method of detection may comprise one or more of the following characteristics:

a step of acquiring the images intended to be processed during the image processing step and a step of instructing the activation of the image acquisition step, triggered automatically as a function of the enumeration of step b);

a step of calculating a result representative of an increase in the number of vehicles enumerated, this result being dependent on the number of vehicles enumerated during step b), and a step of comparing the result with a predetermined activation threshold so as to automatically trigger at least one of the instruction steps if this threshold is crossed;

a step of calculating the result and/or the predetermined activation threshold as a function of the mean number of motor vehicles simultaneously present on this stretch observed over previous time intervals;

a step of instructing the activation of the image processing step if one of the vehicle detectors placed at the entrance or at the exit of the stretch becomes inoperative;

a step of measuring the ambient noise with the aid of acoustic sensors and a step of comparing the ambient noise measured with the predetermined span of ambient noise powers to determine whether the detector is inoperative;

a step of generating an alarm signal indicating the presence of a disruptive object on the stretch of road, this generating step being triggered automatically as a function at one and the same time of results obtained during the image processing step and during the enumerating step.

These embodiments of the method of detection furthermore exhibit the following advantages:

the automatic activation of the step of acquiring images as a function of the number of motor vehicles simultaneously present on the stretch of road also makes it possible to limit the energy consumption and to decrease the amount of information transmitted between an image acquisition module and an image processing module;

the activation of the image processing in response to the increase in the number of vehicles enumerated makes it possible to rapidly detect a disruptive object without the image processing being activated permanently;

the fixing of the result and/or of the predetermined activation threshold as a function of the mean number of motor vehicles simultaneously present on the stretch of road increases the robustness of the method of detection in relation to variations in the intensity of the road traffic;

the automatic activation of the image processing step, when at least one of the vehicle detectors is inoperative, makes it possible to detect a disruptive object even though one of the vehicle detectors is not useable; and the combination of results obtained on the basis of the image processing and of the counting of the vehicles makes it possible to more reliably estimate the probability that a disruptive object is present on the stretch.

The subject of the invention is also a system for detecting the presence of a disruptive object on a stretch of road, this system comprising:

an image processing module able to detect the presence of the disruptive object on the basis of images of the said stretch, at least one first and one second motor vehicle detector placed respectively at an entrance and at an exit of this stretch, a module for enumerating motor vehicles simultaneously present on this stretch on the basis of data gleaned by the first and second detectors, and a module for activating the processing module suitable for automatically triggering the activation of the processing module as a function of the enumeration established by the enumeration module.

The embodiments of this detection system may comprise one or more of the following characteristics:

a module for acquiring the images intended to be processed by the image processing module, and the activation module (34) is also able to automatically trigger the activation of the acquisition module as a function of the enumeration established by the enumeration module;

the motor vehicle detectors each comprise at least one acoustic sensor for detecting the passage of a motor vehicle on the basis of the sound wave generated by this vehicle, this or each sensor being intended to work in a predetermined span of ambient noise powers, the system comprises a module for establishing the power of the ambient noise, and the activation module is able to automatically activate the image processing module if the ambient noise power established is incompatible with the predetermined span of ambient noise powers.

The subject of the invention is also an activation unit able to be implemented in the detection method or system hereinabove.

The invention will be better understood on reading the description which follows, given solely by way of example and with reference to the drawings in which:

FIG. 1 represents a system 2 for detecting the presence of a disruptive object on a road 4.

Figure 1:
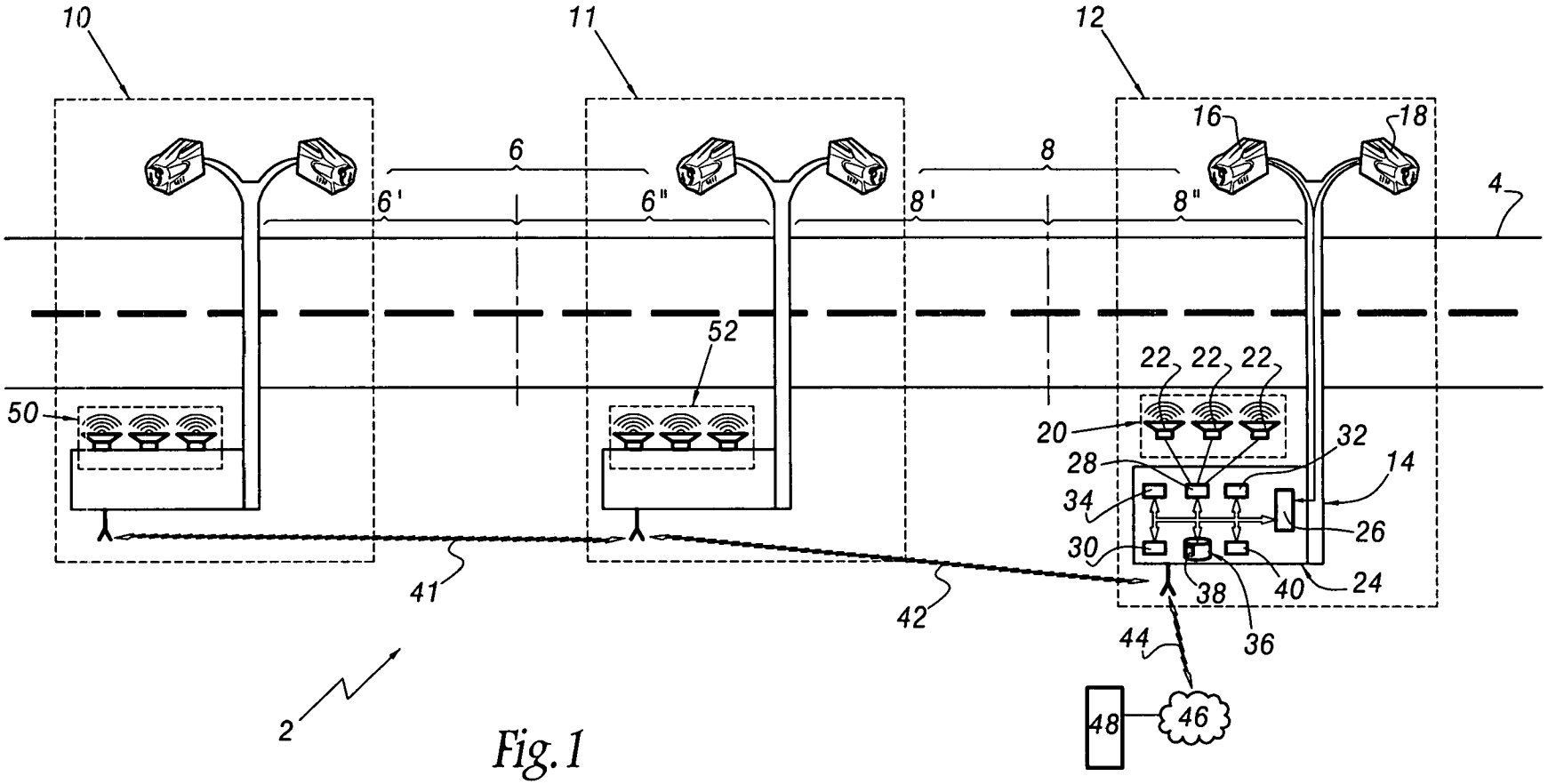
FIG. 1 is a schematic illustration of a system for detecting a disruptive object on a stretch of road.

To simplify FIG. 1, only two successive stretches 6 and 8 of the road 4 are illustrated. The description which follows of the system 2 will be offered solely in regard to these two stretches. Here, the stretches 6 and 8 are each divided into two portions respectively 6' and 6", and 8' and 8".

The system 2 comprises a road traffic beacon placed at the entrance and at the exit of each stretch of road. Here, the system 2 comprises a beacon 10 at the entrance of the stretch 6, a beacon 11 common to the exit of the stretch 6 and to the entrance of the stretch 8 and a beacon 12 at the exit of the stretch 8. The beacons 10 to 12 are, for example, all identical and only the beacon 12 will be described here in detail. The beacon 12 comprises a vertical mast 14 at the upper end of which are fixed two picture-taking apparatuses 16 and 18. The apparatus 16 is turned towards the stretch 8 to take images of the portion 8" of the stretch 8 while the apparatus 18 is turned towards the following stretch of the road 4.

The beacon 12 also comprises a vehicle detector 20 able to detect the passage of a vehicle in proximity on the road 4 so as to count the number of vehicle exiting the stretch 8. This detector is, for example, embodied with the aid of a matrix of acoustic sensors 22. In FIG. 1, only three acoustic sensors 22 are represented for each detector.

The apparatuses 16 and 18 as well as the various acoustic sensors 22 are linked to a local circuit 24 for data processing. For example, the circuit 24 is housed in an electrical cabinet placed at the foot of the mast 14.

The circuit 24 comprises:

- a module 26 for acquiring the images taken by the apparatuses 16 and 18,
- a module 28 for enumerating suitable for enumerating the vehicles detected by the detector 20 during a given time interval vT,
- a conventional module 30 for processing the images acquired by the module 26, suitable for automatically detecting the presence of a disruptive object on the stretch 8 on the basis of the analysis of these images,
- a module 32 for establishing the ambient noise on the basis of the measurements carried out by the sensors 22, when no vehicle is present on the stretch 8,
- a module 34 for activating the processing module 30 as a function of the enumeration established by the module 28 or of ambient noise-related information established by the module 32. The circuit 24 also comprises a memory 36 in which is recorded a predetermined span 38 of operation for the acoustic sensors 22. The span 38 defines in particular a maximum ambient noise power threshold beyond which the detector 20 is unuseable for detecting the passage of a vehicle.

The circuit 24 also comprises a radio module 40 suitable for exchanging information by way of a radio link with the road traffic beacons placed upstream and downstream along the road 4. Here, only the radio links 41 and 42 between, respectively, the beacons 10 and 11, and 11 and 12 are represented.

In the particular case of the beacon 12, the radio module 40 is also able to establish a radio link 44 with an information transmission network 46, in such a way as to be able to communicate with a platform 48 for supervising the road traffic on the road 4.

The network 46 is, for example, a telephone network.

The platform 48 is a computer server or a set of computer servers suitable for managing the traffic on a road network comprising in particular the road 4.

In FIG. 1, the vehicle detectors of the beacons 10 and 11 bear the references 50 and 52 respectively.

Figure 2:
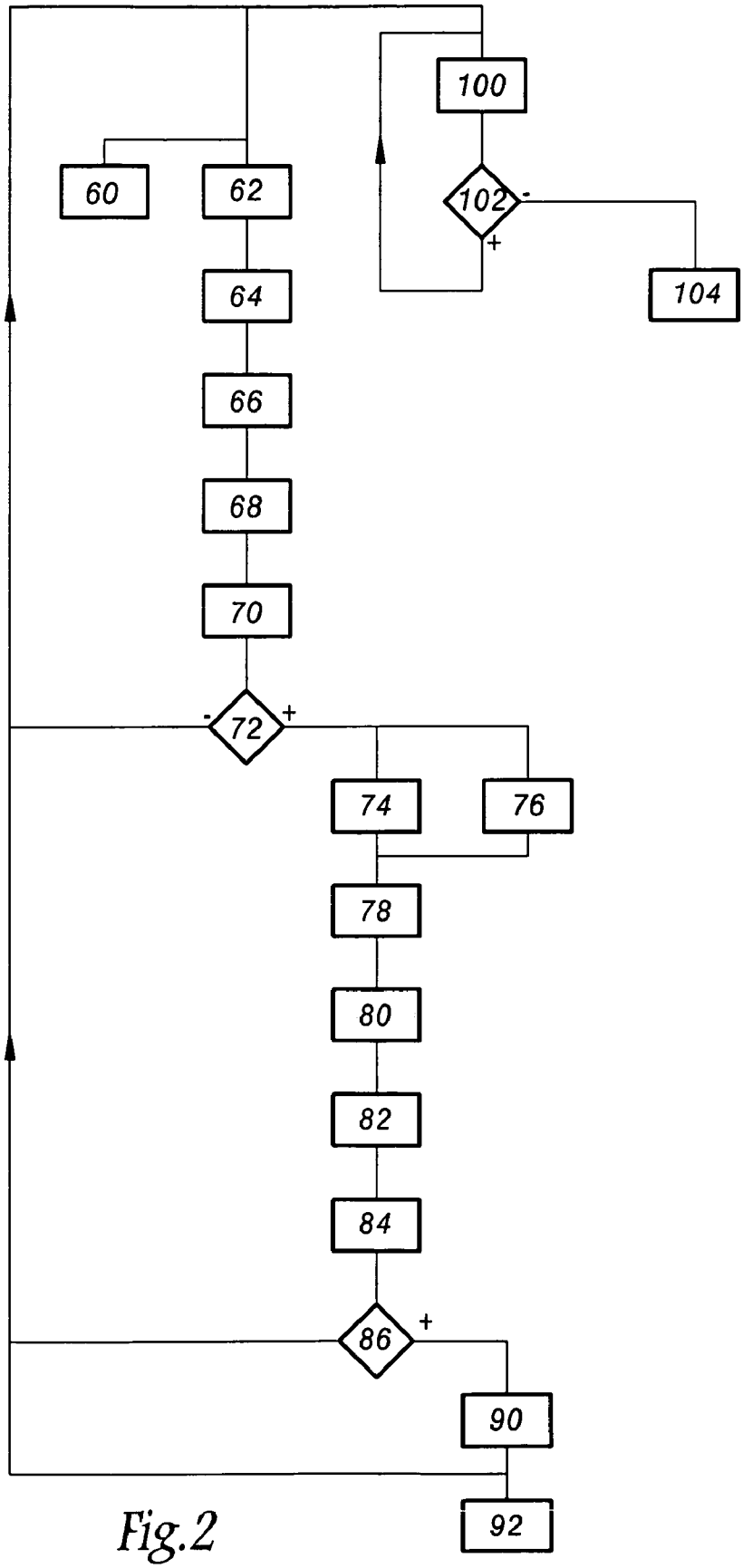
FIG. 2 is a flowchart of a method of detecting a disruptive object on a stretch of road.

The operation of the system 2 will now be described with regard to the method of FIG. 2 in the particular case of the beacons 11 and 12 and of the stretch 8.

During the operation of the system 2, the vehicle detectors operate permanently, during a step 60, to detect the passage of a vehicle in proximity to one of the beacons 10 to 12. Typically, the passage of a vehicle in proximity to one of the detectors is detected by measuring with the aid of the sensors 22 the power of the sound wave generated by this vehicle. For example, the power of the sound wave measured is compared with a threshold and if this threshold is exceeded then a vehicle is detected. Moreover, on the basis of the direction of travel of the sound wave, each detector determines the direction of travel of the vehicle detected in such a way as to distinguish the vehicles entering or vehicles exiting the stretch, if the road 4 is a two-way road.

During a predetermined time interval δT, the module 28 of each beacon counts, during a step 62, the number of vehicles which have passed during this interval δT in proximity to this beacon on the basis of the data gleaned by the detector 20.

At the end of the time interval δT, the number of vehicles entering the stretch 8 that were counted by the beacon 11 is transmitted, during a step 64, to the beacon 12 by way of the radio link 42.

The module 28 of the beacon 12 then enumerates, during a step 66, the vehicles simultaneously present on the stretch 8. For this purpose, the beacon 12 uses, for example, the following relation:

$$S(t)=S(t-1)+N_{11}(t)-N_{12}(t)$$

where:

S(t) is the number of vehicles simultaneously present on the stretch 8 during the current time interval delta T, S(t−1) represents the number of vehicles simultaneously present on the stretch 8 during the previous time interval delta T, $N_{11}(t)$ is the number of vehicles entering the stretch 8 that were counted by the beacon 11 during the current time interval delta T, and $N_{12}(t)$ is the number of vehicles exiting the stretch 8 that were counted by the beacon 12 during the current time interval delta T.

Thereafter, the beacon 12 calculates, during a step 68, an incident threshold $S_i$ as a function of a mean $S_m$, calculated over several previous time intervals delta T, of the number of vehicles simultaneously present on the stretch 8. For example, the threshold $S_i$ is equal to at least twice the mean $S_m$ and is at least equal to 1.

Thereafter, during a step 70, the beacon 12 calculates a result representative of the increase in the number of vehicles on the stretch 8. This result is here a probability $P_i$ that a disruptive object is actually present on the stretch 8. The probability $P_i$ is established as a function of the data gleaned by the detectors 20 and 52 and more precisely as faunction of the number of vehicles enumerated during step 66. For example, this probability $P_i$ is calculated with the aid of the following relation:

$$\text{If } S(t)<S_m \text{ then } P_i=0$$

$$\text{If } S_i>S(t)\geqq S_m \text{ then } P_i=(S(t)-S_m)/(S_i-S_m)$$

$$\text{If } S(t)\geqq S_i \text{ then } P_i=1$$

During a step 72, this probability $P_i$ is compared with an image processing activation threshold $S_a$. For example, $S_a$ is equal to 0.5. If the probability $P_i$ is less than the threshold $S_a$, then the method returns to step 60 and the image processing module 30 is not activated or is deactivated.

In the converse case, the module 34 instructs the activation, during a step 74, of the apparatus 16 and of the modules 26 and 30 of the beacon 12.

In parallel, during a step 76, the activation unit 34 also instructs the activation of the modules 26 and 30 of the beacon 11 as well as of the picture-taking apparatus of the beacon 11 turned towards the portion 8' of the stretch 8.

During a step 78, the activated picture-taking apparatuses take images at regular intervals of the stretch 8. These images are acquired by the image acquisition modules 26 and transmitted to the respective processing modules 30 of the beacons 11 and 12. During a step 80, the processing modules 30 of the beacons 11 and 12 determine on the basis of the analysis of the images acquired, a probability $P_v$ that a disruptive object is present on the stretch 8.

Once this probability $P_v$ has been determined, the beacon 11 transmits, during a step 82, the probability $P_v$ that it has determined to the beacon 12 by way of the radio link 42.

During a step 84, the beacon 12 combines the probabilities $P_v$ determined by the beacons 11 and 12 and the probability $P_i$ established by the beacon 12, in such a way as to establish an incidents estimator $E_i$. For example, the estimator $E_i$ is calculated with the aid of the following relation:

$$E_i=P_{v11}+P_{v12}+P_i \tag{3}$$

where:

$P_{v11}$ is the probability $P_v$, determined by the beacon 11, of the presence of a disruptive object, $P_{v12}$ is the probability $TP_v$ determined by the beacon 12, of the presence of a disruptive object, and $P_i$ is the incident probability established by the beacon 12 on the basis of the data gleaned by the detectors 20 and 52.

The estimator $E_i$ is compared, during a step 86, with a predetermined alarm threshold $S_b$. If the estimator $E_i$ is less than the threshold $S_b$, then the method returns to step 62.

In the converse case, that is to say if there exists a strong probability that a disruptive object is present on the stretch 8, then the beacon 12 transmits, during a step 90, an alarm to the platform 48 by way of the link 44 and of the network 46 and then returns to step 62.

The platform 48 receive this alarm and acts accordingly during a step 92. For example, the platform 48 automatically instructs the displaying on a luminous signalling panel of a message indicating that a disruptive object is located on the stretch 8.

In parallel with steps 60 to 90, the sensors 22 of the beacon 12 are also used, during a step 100, to measure the power of the ambient noise when no motor vehicle is present in proximity to the beacon. The power thus measured is then compared, during a step 102, with the operating span 38. If the ambient noise power measured lies within the operating span, then the method returns to step 100.

In the converse case, the system 2 toggles into a degraded operating mode. For example, if the ambient noise in proximity to the beacon 12 is too high, the unit 34 automatically and systematically instructs the activation, during a step 104, of the apparatus 16, of the module 26 and of the module 30 of the beacon 12 as well as of the apparatus and of the corresponding modules in the beacon 11, in such a way as to be capable of rapidly detecting the presence of a disruptive object on the stretch 8, by image processing. Thus, in this degraded operating mode, the image processing is used to alleviate the fact that the detector 20 is unuseable or inoperative.

What was described hereinabove in the particular case of the stretch 8 and of the beacons 11 and 12 applies to all pairs of beacons placed at the entrance and at the exit of a stretch of road.

Thus, in the system 2, since the image processing is activated only when the probability that there is a disruptive object on a stretch is high, this limits the consumption of energy of each of the beacons, thereby increasing their autonomy.

Figure 3:
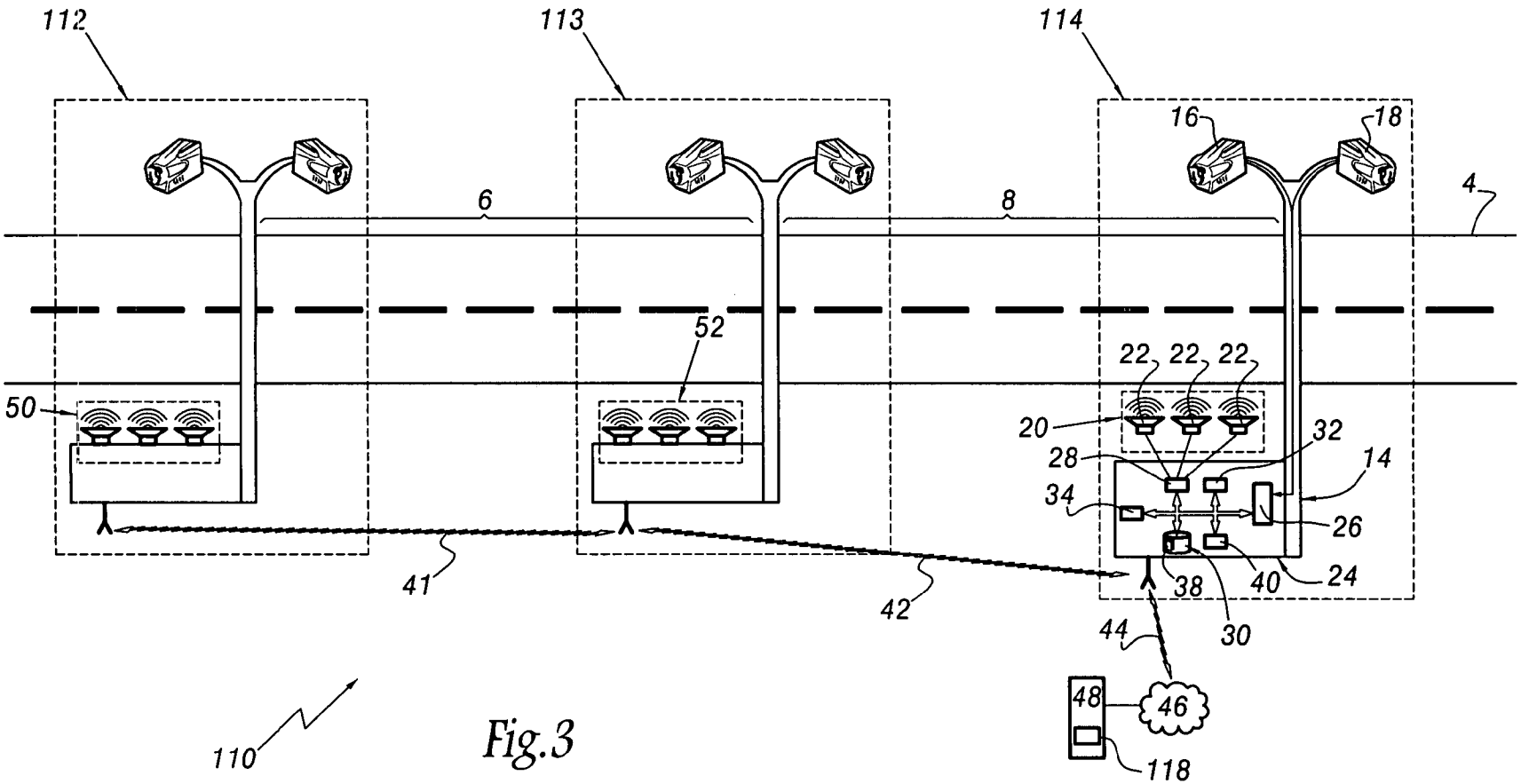
FIG. 3 is another embodiment of the system of FIG. 1.

FIG. 3 represents a system 110 for detecting a disruptive object on the stretch of road 4. In FIG. 3, the elements already described in regard to FIG. 1 bear the same numerical references. Here, only three beacons 112, 113 and 114 placed respectively at the location of the beacons 10, 11 and 12 of FIG. 1 are represented. The beacons 112 to 114 are identical and only the beacon 114 will be described in detail. The beacon 114 is identical to the beacon 12 with the exception that it is devoid of any image processing module 30.

In the system 110, the processing of the images is performed in the platform 48. For this purpose, the platform 48 comprises an image processing module 118 common to the whole set of road traffic beacons of the system 110. The module 118 like the module 30 is able to establish a probability $P_v$ that a disruptive object is present on a stretch on the basis of images acquired by the picture-taking apparatuses of the beacons 112 to 114. The platform 48 is here able to trigger an alarm if the probability $P_v$ combined or not with the probability $P_i$ exceeds a predetermined threshold and to act accordingly.

The operation of the system 110 follows from the operation of the system 2. The main difference resides in the fact that the images acquired by the module 26 are only transmitted to the module 118 when the probability $P_i$ established by a beacon is greater than the threshold $S_a$. Thus, in this embodiment, the activation unit 34 makes it possible to limit the band width required to transmit images from a beacon to the platform 48. The presence of the activation module 34 also makes it possible to limit the calculational power necessary to execute the image processing, since it is highly improbable that the module 118 has to process inparallel the images acquired by the whole set of road traffic beacons of the system 110.

Numerous other embodiments of the system 2 and 110 are possible. For example, the acoustic sensors may be replaced with microwave radars, ultrasounds, magnetic sensors or other sensors able to detect the passage of a vehicle at a given point of a road.

Each beacon can comprise a single picture-taking apparatus or on the contrary more than two picture-taking apparatuses.

Here, the calculation of the probability $P_i$ is carried out locally by the beacons. As a variant, this calculation can be off-loaded to the platform 48, this requiring that the numbers S(t) established by each of the beacons be transmitted in real time to the platform 48.

As a variant, the acquisition of the images is activated permanently and the processing module alone is activated when necessary by the module 34.

Preferably, the enumerating module establishes on the basis of the data gleaned by the detector 20 a mean number of vehicles counted, accompanied by a standard deviation for this mean.

As a variant, the activation threshold $S_a$ is dependent on the mean $S_m$.

The invention claimed is:

1. Method of detecting the presence of a disruptive object on a stretch of road, this method comprising:

a) a step of processing images to detect the presence of the disruptive object on the basis of images of the said stretch, b) a step of enumerating the vehicles simultaneously present on the stretch of road on the basis of data gleaned by a first and a second vehicle detector placed respectively at an entrance and at an exit of this stretch, and c) a step of instructing the activation of the image processing step, triggered automatically as a function of the enumeration of step b).

2. Method according to claim 1, wherein it comprises:

a step of acquiring the images intended to be processed during the image processing step, and a step of instructing the activation of the image acquisition step, triggered automatically as a function of the enumeration of step b).

3. Method according to claim 1, wherein the method comprises:

a step of calculating a result representative of an increase in the number of vehicles enumerated, this result being dependent on the number of vehicles enumerated during step b), and a step of comparing the result with a predetermined activation threshold so as to automatically trigger at least the instruction step if this threshold is crossed.

4. Method according to claim 3, wherein it comprises a step of calculating the result and/or the predetermined activation threshold as a function of the mean number of motor vehicles simultaneously present on this stretch observed over previous time intervals.

5. Method according to claim 1, wherein it comprises a step of instructing the activation of the image processing step if one of the vehicle detectors placed at the entrance or at the exit of the stretch becomes inoperative.

6. Method according to claim 5 for vehicle detectors each comprising at least one acoustic sensor for detecting the passage of a motor vehicle on the basis of the sound wave generated by this motor vehicle, this or each sensor being intended to work in a predetermined span of ambient noise powers, wherein the method comprises:

a step of measuring the ambient noise with the aid of these acoustic sensors, and a step of comparing the ambient noise measured with the predetermined span of ambient noise powers to determine whether the detector is inoperative.

7. Method according to claim 1, wherein the method comprises a step of generating an alarm signal indicating the presence of a disruptive object on the stretch of road, and in that this generating step is triggered automatically as a function at one and the same time of results obtained during the image processing step and during the enumerating step.

8. System for detecting the presence of a disruptive object on a stretch of road, wherein the system comprises:

an image processing module able to detect the presence of the disruptive object on the basis of images of the said stretch, at least one first and one second motor vehicle detector placed respectively at an entrance and at an exit of this stretch, a module for enumerating motor vehicles simultaneously present on this stretch on the basis of data gleaned by the first and second detectors, and a module for activating the processing module suitable for automatically triggering the activation of the processing module as a function of the enumeration established by the enumeration module.

9. System according to claim 8, wherein the system comprises a module for acquiring the images intended to be processed by the image processing module, and wherein the activation module is also able to automatically trigger the activation of the acquisition module as a function of the enumeration established by the enumeration module.

10. System according to claim 8, wherein:

the motor vehicle detectors each comprise at least one acoustic sensor for detecting the passage of a motor vehicle on the basis of the sound wave generated by this vehicle, this or each sensor being intended to work in a predetermined span of ambient noise powers, the system comprises a module for establishing the power of the ambient noise, and the activation module is able to automatically activate the image processing module if the ambient noise power established is incompatible with the predetermined span of ambient noise powers.

11. Activation module able to be implemented in a system in accordance with one of claims 8 to 10, wherein the activation module is able to automatically trigger the activation of the image processing module as a function of the enumeration established by the enumerating module.

* * * * *